US008122555B2

(12) United States Patent
Kim

(10) Patent No.: US 8,122,555 B2
(45) Date of Patent: Feb. 28, 2012

(54) APPARATUS FOR CLEANING FLOOR

(76) Inventor: Yong Wook Kim, Hwaseong-Si (KR)

( * ) Notice: Subject to any disclaimer, the term of this patent is extended or adjusted under 35 U.S.C. 154(b) by 605 days.

(21) Appl. No.: 12/203,223

(22) Filed: Sep. 3, 2008

(65) Prior Publication Data

US 2009/0271935 A1 Nov. 5, 2009

(30) Foreign Application Priority Data

May 2, 2008 (KR) ..... 10-2008-0041495
May 2, 2008 (KR) ..... 10-2008-0041496
May 2, 2008 (KR) ..... 10-2008-0041497
May 2, 2008 (KR) ..... 10-2008-0041498

(51) Int. Cl.
*A47L 11/12* (2006.01)

(52) U.S. Cl. ..... 15/98; 15/52.2; 451/351

(58) Field of Classification Search ..... 15/50.2, 15/52.2, 98; 451/351
See application file for complete search history.

(56) References Cited

U.S. PATENT DOCUMENTS 1,635,480 A * 7/1927 Jacobson ..... 451/351
RE24,583 E * 12/1958 Brown ..... 15/98
3,731,334 A * 5/1973 Carbonell ..... 15/50.1
4,747,176 A * 5/1988 Parks ..... 15/230.16
5,511,271 A * 4/1996 Shishido et al. ..... 15/49.1

FOREIGN PATENT DOCUMENTS

| | | | |
|---|---|---|---|
| EP | 1344484 | * | 9/2003 |
| EP | 1396223 | * | 3/2004 |
| JP | 2002-224007 | * | 8/2002 |
| JP | 2004073566 | | 3/2004 |
| JP | 2004105592 | | 4/2004 |
| KR | 200376000 | | 2/2005 |
| KR | 200434330 | | 12/2006 |
| KR | 200438294 | | 1/2008 |

* cited by examiner

*Primary Examiner* — Mark Spisich
(74) *Attorney, Agent, or Firm* — Harness, Dickey & Pierce, PLC

(57) ABSTRACT

An apparatus for cleaning floor is disclosed, which is capable of maximizing a user's convenience by an automatic operation, minimizing jolt or vibration generated for its operation, and realizing enhanced endurance and safety, wherein the apparatus includes first and second movable members rectilinearly reciprocating along the same straight line in opposite directions with each other.

16 Claims, 5 Drawing Sheets

APPARATUS FOR CLEANING FLOOR

CROSS-REFERENCE TO RELATED APPLICATIONS

This application claims the benefit of the Korean Patent Application Nos. 10-2008-0041495, 10-2008-0041496, 10-2008-0041497, and 10-2008-0041498 filed on May 2, 2008, all of which are hereby incorporated by reference for all purposes as if fully set forth herein.

FIELD

The present disclosure relates to an apparatus for cleaning floor, and more particularly, to an apparatus for cleaning floor, which is capable of maximizing a user's convenience by an automatic operation, minimizing jolt or vibration generated for its operation, and realizing enhanced endurance and safety.

BACKGROUND

Generally, when cleaning the floor of house or office through the use of wet floorcloth, a conventional art cleaning method using the wet floorcloth largely depends on user's physical works. If the user tries to clean the floor with a conventional art cleaning apparatus using the wet floorcloth, the user has to apply a large physical force so as to reciprocate the conventional art cleaning apparatus using the wet floorcloth. Thus, if taking a long period of time to clean the floor with the conventional art cleaning apparatus, the user feels physical fatigue and the cleaning efficiency also becomes lowered.

Especially, if cleaning a tiled bathroom or veranda floor through the use of conventional art apparatus, it may cause an excessively heavy work for the user since the user repeatedly rubs the floor with a brush being pressed down on the floor by applying a physical force thereto, so as to remove stubborn dirt from the tiled bathroom or veranda floor.

In the meantime, there is a recent development of steam cleaner especially suitable for cleaning the floor. However, if the steam cleaner driven by an electric power is used for the tiled bathroom or veranda floor, an electric leakage or shock may occur. Also, this steam cleaner requires a user's heavy work to repeatedly rub the floor.

In order to overcome this problem of the steam cleaner, wheels are additionally provided in the bottom of steam cleaner so as to minimize a frictional force between the floor and the steam cleaner. However, in consideration of the fact that the dirt is removed from the floor by the frictional force between the floor and the steam cleaner, the minimized frictional force therebetween may cause the deterioration of cleaning efficiency.

SUMMARY

Accordingly, the present invention is directed to an apparatus for cleaning floor that substantially obviates one or more problems due to limitations and disadvantages of the related art.

An object of the present invention is to provide an apparatus for cleaning floor which is capable of maximizing a user's convenience by an automatic operation.

Another object of the present invention is to provide an apparatus for cleaning floor which is capable of minimizing jolt or vibration generated for its operation.

Another object of the present invention is to provide an apparatus for cleaning floor which is capable of realizing enhanced endurance and safety.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an apparatus for cleaning floor comprises a support member; a driver positioned on the support member; a power converter for converting a rotary motion provided from the driver into a power for a rectilinear reciprocating motion; and first and second movable members rectilinearly reciprocating along the same straight line in opposite directions with each other through the use of power provided from the power converter, wherein the driver comprises a driving motor; a first interlocking pulley rotated by the driving motor; a second interlocking pulley; and an interlocking timing belt for transmitting a rotary motion of the first interlocking pulley to the second interlocking pulley.

It is to be understood that both the foregoing general description and the following detailed description of the present invention are exemplary and explanatory and are intended to provide further explanation of the invention as claimed.

DRAWINGS

The accompanying drawings, which are included to provide a further understanding of the invention and are incorporated in and constitute a part of this application, illustrate embodiment(s) of the invention and together with the description serve to explain the principle of the invention. In the drawings.

Figure 4:
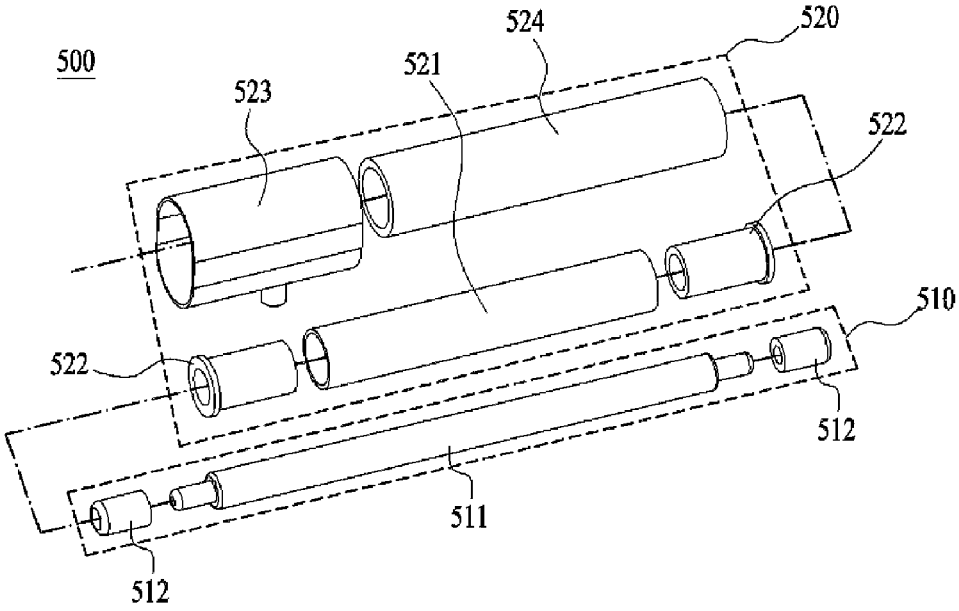
Figure 5:
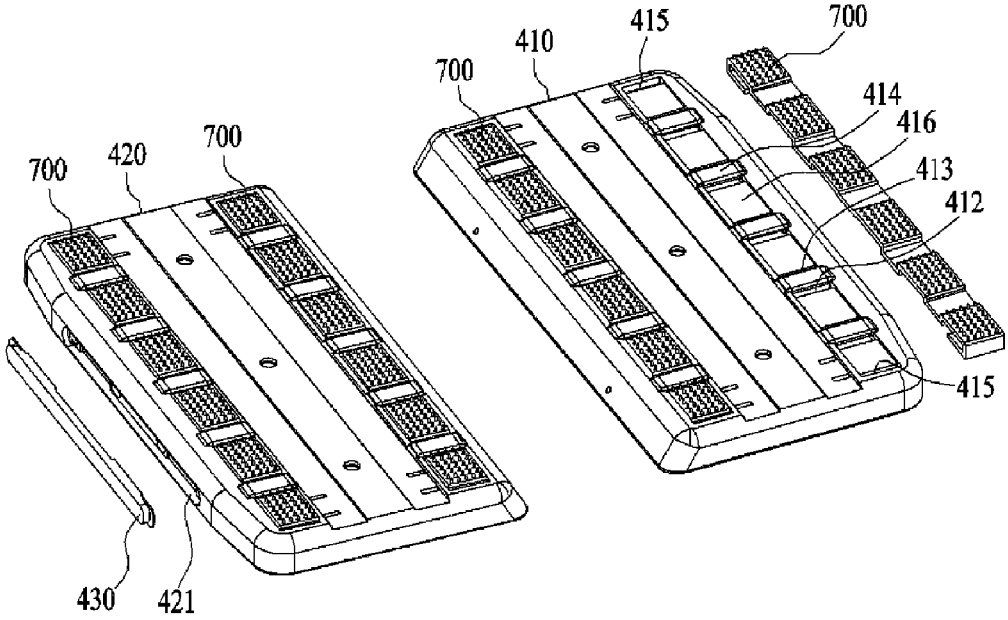
Figure 6:
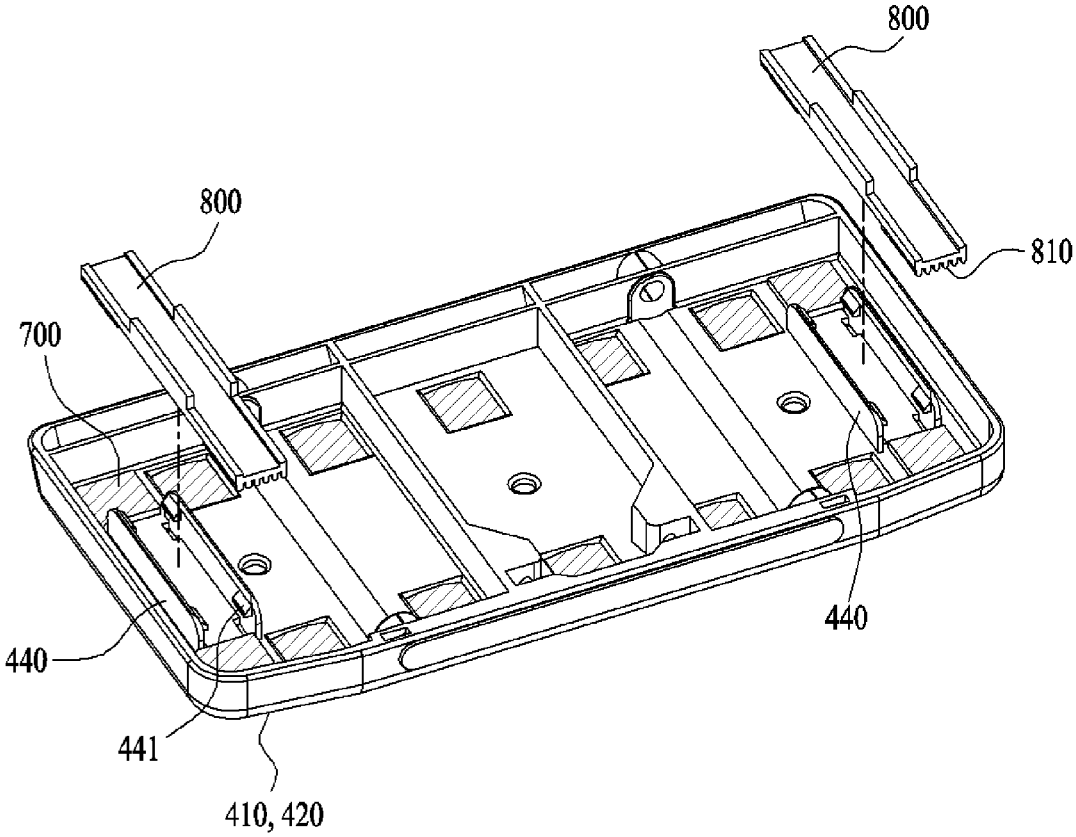

FIG. 4 illustrates an exploded perspective view of a course guiding means to guide a rectilinear reciprocating motion of a movable member according to one embodiment of the present invention; and FIG. 5 illustrates a movable member and a Velcro fixed on the movable member in an apparatus for cleaning floor according to a first embodiment of the present invention, and FIG. 6 illustrates a movable member and a Velcro fixed on the movable member in an apparatus for cleaning floor according to a second embodiment of the present invention.

DETAILED DESCRIPTION

Reference will now be made in detail to the preferred embodiments of the present invention, examples of which are illustrated in the accompanying drawings. Wherever possible, the same reference numbers will be used throughout the drawings to refer to the same or like parts.

Hereinafter, an apparatus for cleaning floor according to the present invention will be described with reference to the accompanying drawings.

Figure 1:
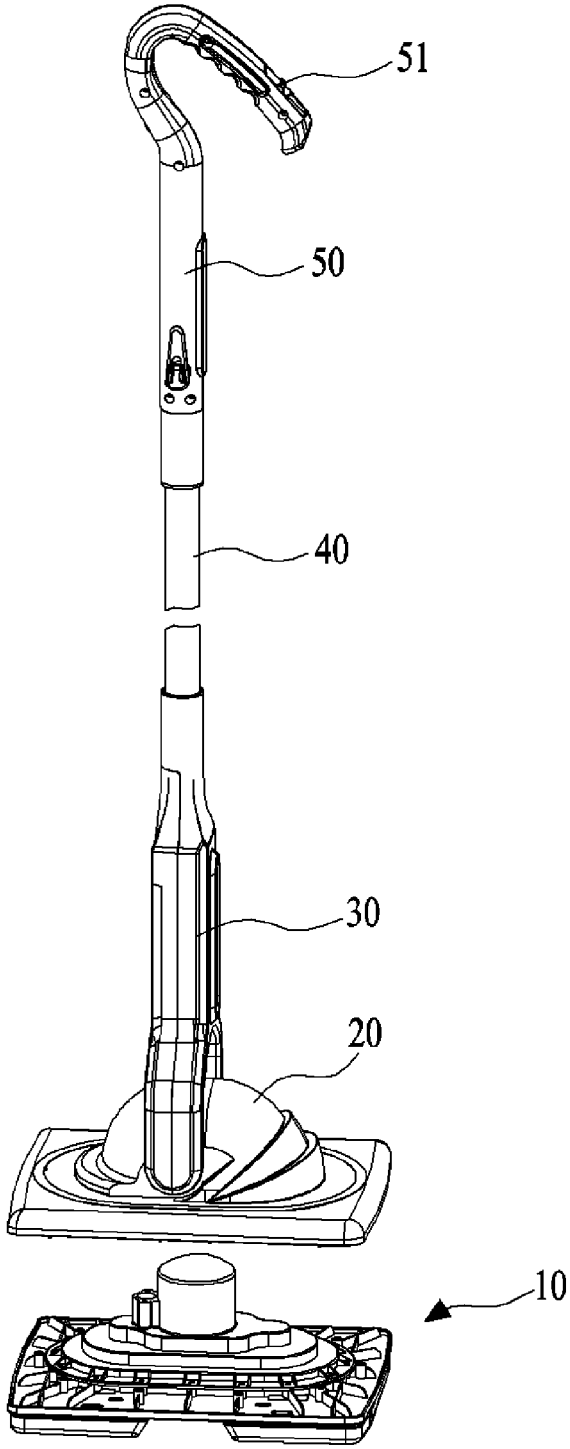
FIG. 1 illustrates a schematic perspective view of an apparatus for cleaning floor according to the present invention.

FIG. 1 illustrates a schematic perspective view of an apparatus for cleaning floor according to the present invention. As shown in FIG. 1, the apparatus for cleaning floor according to the present invention includes a body 10; a cover 20 for covering the body 10; a power source 30 for supplying a power to the body 10, wherein the power source 30 is pivotally connected with the cover 20; a grip 50 with an on-off switch 51 to turn on/off the apparatus for cleaning floor; and a connector 40 for connecting the power source 30 and the grip 50 with each other, wherein the connector 40 is adjustable in its length.

In order to operate the apparatus placed in water without an electric leakage, it is preferable that a battery provided in the power source 30 be a waterproof-type chargeable battery (not shown). When the switch 51 positioned in the grip 50 is turned-on, the power source 30 supplies the power to the body 10.

Schematically, the body 10 of the apparatus for cleaning floor according to the present invention includes a support member; a driver positioned on the support member; a power converter for converting a rotary motion provided from the driver into a rectilinear reciprocating motion; a movable member rectilinearly reciprocated by the power provided from the power converter; a course guiding means to guide the rectilinear reciprocating motion of the movable member; a waterproofing part for waterproofing the driver; and a Velcro for detachably providing a cleaning member on the movable member.

Hereinafter, the body 10 of the apparatus for cleaning floor according to the present invention will be explained in detail as follows.

Figure 2:
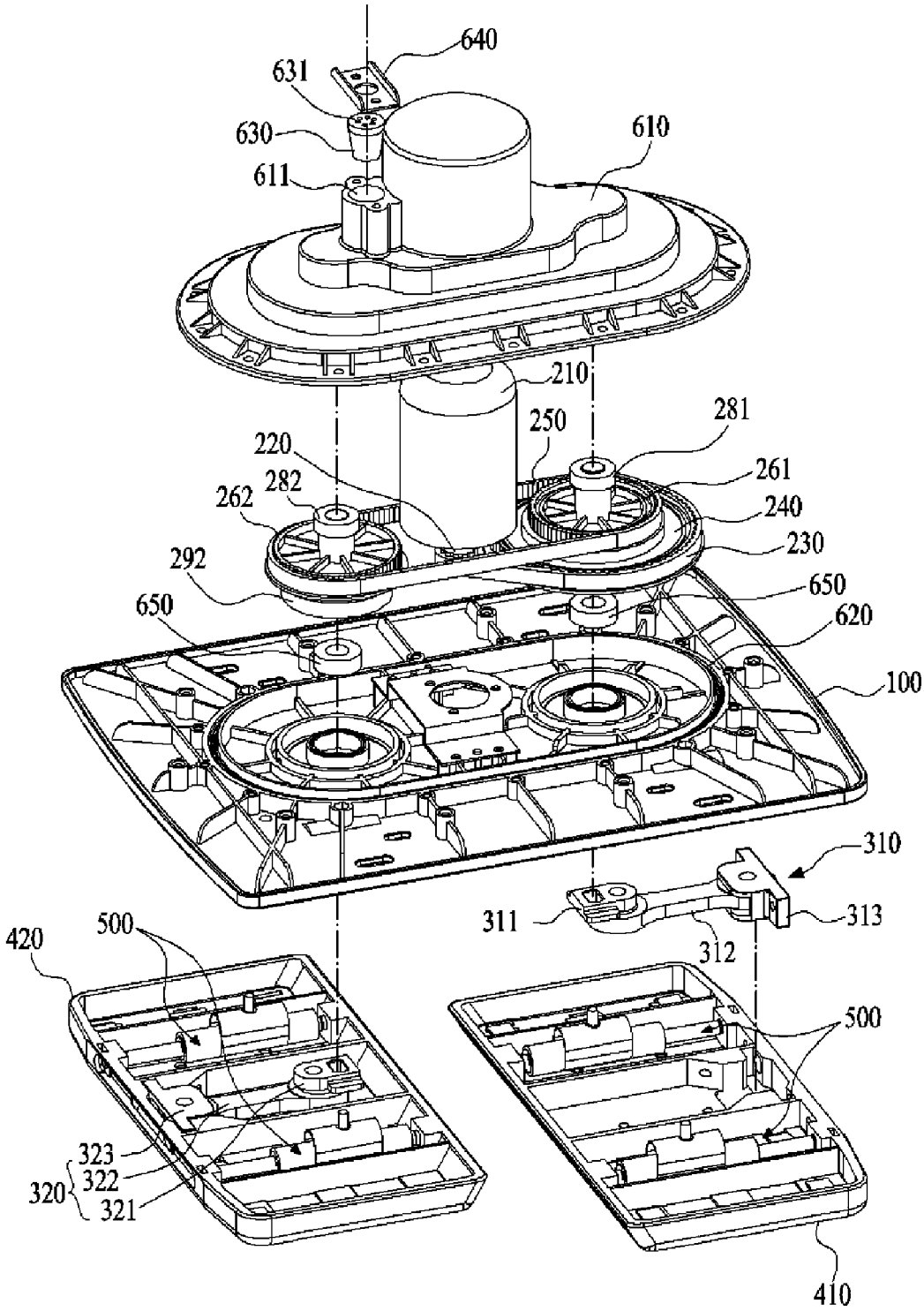
FIGS. 2 and 3 illustrate exploded perspective views of an apparatus for cleaning floor according to one embodiment of the present invention.
Figure 3:
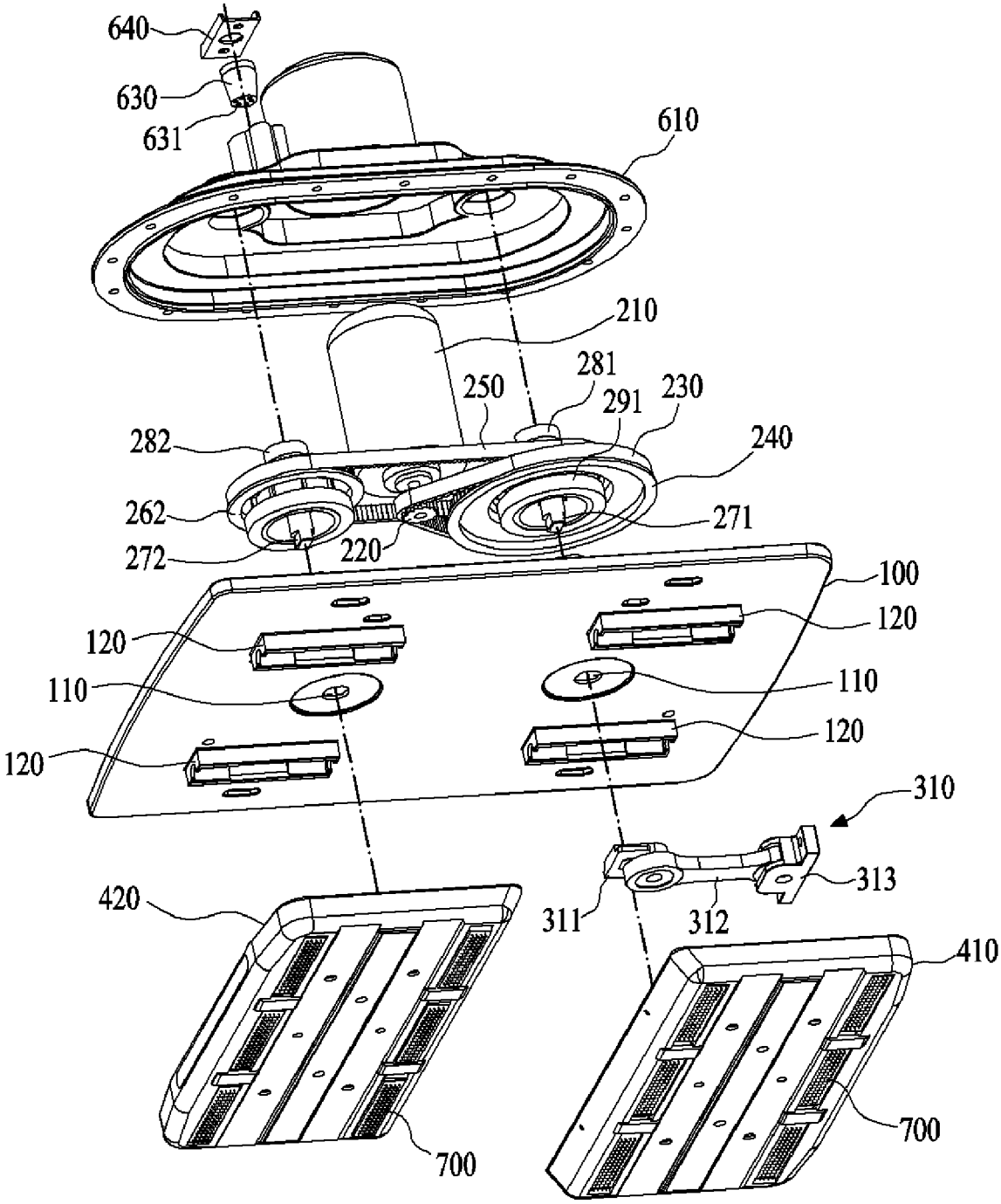

FIGS. 2 and 3 illustrate exploded perspective views of an apparatus for cleaning floor according to one embodiment of the present invention.

The body 10 of the apparatus for cleaning floor includes a support member 100; and a driver positioned on the support member 100. The driver includes a driving motor 210. As the switch 51 of the grip 50 is turned-on, the power is supplied from the power source 30 to the driving motor 210. A motor pulley 220 connected with a shaft of the driving motor 210 rotates together with the operation of the driving motor 210.

The driver of the apparatus for cleaning floor according to one embodiment of the present invention includes a speed-reduction pulley 240 which receives the rotary motion of the motor pulley 220 through a motor timing belt 230, and rotates by the received rotary motion. Herein, a rotation speed of the speed-reduction pulley 240 is slower than a rotation speed of the motor pulley 220 since the speed-reduction pulley 240 is larger in diameter than the motor pulley 220.

A first interlocking pulley 261 is connected with the speed-reduction pulley 240 on the same rotation axis so that the first interlocking pulley 261 rotates together with the speed-reduction pulley 240. Selectively, the speed-reduction pulley 240 and the first interlocking pulley 261 may be formed as one body. The driver according to the present invention includes a second interlocking pulley 262 which rotates by the rotary motion of the first interlocking pulley 261 received through an interlocking timing belt 250. In this case, it is important that the first and second interlocking pulleys 261 and 262 should have the same diameter so as to secure the same rotation speed when rotating the first and second interlocking pulleys 261 and 262.

The driver according to the present invention can transmit the rotary motion of the driving motor 210 through the use of a gear instead of the pulley and timing belt. In order to minimize noises generated during the operation of the apparatus, the method using the pulley and timing belt is preferable to the method using the gear.

A first interlocking pulley shaft 271 is connected with the center of the first interlocking pulley 261 so that the first interlocking pulley shaft 271 rotates in association with the first interlocking pulley 261. Also, a second interlocking pulley shaft 272 is connected with the center of the second interlocking pulley 262 so that the second interlocking pulley shaft 272 rotates in association with the second interlocking pulley 262. The first and second interlocking pulley shafts 271 and 272 are connected with a power converter through a shaft hole 110 formed in the support member 100.

There are first and second upper bearings 281 and 282 respectively provided on the upper portions of the first and second interlocking pulley shafts 271 and 272 so as to reduce a frictional resistance against a waterproofing cover 610. Also, there are first and second lower bearings 291 and 292 respectively provided on the lower portions of the first and second interlocking pulley shafts 271 and 272 so as to reduce a frictional resistance against the support member 100.

The power converter of the apparatus for cleaning floor according to the present invention includes a first power converting member 310 and a second power converting member 320. At this time, the first power converting member 310 converts the rotary motion of the first interlocking pulley shaft 271 into the rectilinear reciprocating motion, to thereby reciprocate the first movable member 410 rectilinearly. Also, the second power converting member 320 converts the rotary motion of the second interlocking pulley shaft 272 into the rectilinear reciprocating motion, to thereby reciprocate the second movable member 420 rectilinearly.

The first power converting member 310 includes a first cam 311, a first cam rod 312, and a first fixation member 313. One side of the first cam 311 is connected with the first interlocking pulley shaft 271 passing through the shaft hole 110 of the support member 100 so that the first cam 311 and the first interlocking pulley shaft 271 rotate on the same rotation axis. One side of the first cam rod 312 is rotatably connected with the other side of the first cam 311. The first fixation member 313 is rotatably connected with the other side of the first cam rod 312 and is fixedly connected with the first movable member 410.

The second power converting member 320 includes a second cam 321, a second cam rod 322, and a second fixation member 323. One side of the second cam 321 is connected with the second interlocking pulley shaft 272 passing through the shaft hole 110 of the support member 1 00 so that the second cam 321 and the second interlocking pulley shaft 272 rotate on the same rotation axis. One side of the second cam rod 322 is rotatably connected with the other side of the second cam 321. The second fixation member 323 is rotatably connected with the other side of the second cam rod 322 and is fixedly connected with the second movable member 420.

In order to make the first and second movable members 410 and 420 rectilinearly reciprocate along the same straight line in opposite directions with each other, a structure of connecting the first cam 311 with the first interlocking pulley shaft 271 is symmetric to a structure of connecting the second cam 321 with the second interlocking pulley shaft 272. That is, owing to the symmetric connection structure and the same diameter of the first and second interlocking pulleys 261 and 262, the first and second movable members 410 and 420 rectilinearly reciprocate along the same straight line on opposite directions with each other. This enables the offset of jolt or vibration generated by the frictional force against the floor during the rectilinear reciprocating motions of the first and second movable members 410 and 420. As a result, there is very little vibration in the entire apparatus including the support member 100. In addition, a user can change a moving direction of the apparatus with easiness, resulting in enhanced convenience.

To secure the precise rectilinear reciprocating motion of the first and second movable members 410 and 420, the apparatus for cleaning floor according to the present invention includes course guiding means 500 to guide the rectilinear reciprocating motion. According to one embodiment of the present invention shown in FIGS. 2 and 3, each of the first and second movable members 410 and 420 is provided with the two course guiding means 500 so as to secure the rectilinear reciprocating motion. However, the number of course guiding means is not limited to this, that is, the number of course guiding means for each movable member may be variable.

FIG. 4 illustrates an exploded perspective view of a course guiding means to guide the rectilinear reciprocating motion of movable member in the apparatus for cleaning floor according to one embodiment of the present invention.

As shown in FIG. 4, the course guiding means 500 includes a sliding member 510 and a guide member 520. As the sliding member 510 is mounted on the first or second movable member 410 or 420, the sliding member 510 rectilinearly reciprocates together with the first or second movable member 410 or 420. The guide member 520, which is fixed in the support member 100, guides the rectilinear reciprocating motion of the sliding member 510.

The sliding member 510 includes a first damper 512 for decreasing the noise generated due to a friction against the shaft 511 and movable members 410 and 420. The first damper 512 is provided for each of the both ends of the shaft.

The guide member 520 includes a hollow cylinder 521 and a bracket 523. In this case, the shaft 511 is inserted into the hollow cylinder 521. Also, the bracket 523 fixes the hollow cylinder 521 in the support member 100, and the bracket 523 is connected with the support member 100 through the use of a screw. On the lower surface of the support member 100, there is a part 120 for containing the guide member 520, that is, the guide member 520 is inserted into the part 120 provided on the lower surface of the support member 100, so as to prevent the guide member 520 from being moved.

Preferably, a second damper 524 is provided between the hollow cylinder 521 and the bracket 523 so as to decrease the vibration and noise generated by the rectilinear reciprocating motion of the shaft 511.

In order to make the shaft 511, inserted into the hollow cylinder 521, smooth to reciprocate rectilinearly, a bearing 522 for reducing the frictional force is inserted into each of both ends of the hollow cylinder 521, preferably.

As the sliding member 510 passes through an insertion hole 421, provided at the lateral side of the movable members 410 and 420, and the hollow cylinder 521 in sequence, the sliding member 510 is mounted on the movable member 410 and 420. Then, the insertion hole 421 is closed by a fixation bar 430 so as to prevent the sliding member 510 from sliding out of the insertion hole 421.

The apparatus for cleaning floor according to the present invention additionally includes a waterproofing part for waterproofing the driver so that the apparatus can be efficiently operated without the electric leakage even in a case of that the body 10 of the apparatus for cleaning floor is placed in water.

The waterproofing part includes a waterproofing cover 610 connected with the support member 100. According as the waterproofing cover 610 is connected with the support member 100, the driver is positioned between the support member 100 and the waterproofing cover 610. In order to prevent the inflow of water through a small gap between the waterproofing cover 610 and the support member 100, the waterproofing cover 610 and the support member 100 are connected with a waterproofing ring 620 such as O-ring interposed therebetween.

A hole 611 is formed in the waterproofing cover 610. In this case, a wire (not shown) for supplying the power to the driving motor 210 passes through the hole 611 of the waterproofing cover 610. To prevent the inflow of water into the hole 611, an elastic member 630 is fixedly inserted into the hole 611 through a press bracket 640. The elastic member 630 includes a hole 631 through which wire is passed. In this case, an original diameter of the hole 631 is smaller than a diameter of the wire, when the hole 631 is observed before the insertion of the wire.

The waterproofing part according to the present invention includes a shaft waterproofing member 650 to prevent the inflow of water into the driver through the shaft hole 110 formed on the support member 100. The shaft waterproofing member 650 includes a hole through which interlocking pulley shafts 271 and 272 are passed.

The apparatus for cleaning floor according to the present invention includes a Velcro 700 to detachably provide a cleaning member (not shown) on the movable member 410 and 420. The Velcro 700 is fixed on the movable member 410 and 420.

FIG. 5 illustrates a movable member and a Velcro fixed on the movable member in an apparatus for cleaning floor according to a first embodiment of the present invention.

To prevent the Velcro 700 from being detached from the movable members 410 and 420 when operating the apparatus being placed in water, first and second holes 412 and 413 are formed in the movable members 410 and 420, respectively. Also, there is a combining rib 414 between the first and second holes 412 and 413. By leading the Velcro 700 along the way from an inlet of the first hole 412 to an outlet of the second hole 413, the Velcro 700 is connected with each movable member 410 and 420. According as the Velcro 700 is fixed by the combining rib 414, it is possible to prevent the Velcro 700 from being detached from the movable members 410 and 420 by a physical force. Preferably, one Velcro 700 is fixed by the plurality of combining ribs 414.

Preferably, a groove 416 for holding the Velcro 700 therein is formed in the lower surface of each of the first and second movable members 410 and 420.

Also, a fixation hole 415 is formed at each of both ends of the movable members 410 and 420. Both ends of the Velcro 700 are fixed on the opposite surfaces of the movable members 410 and 420 through the fixation hole 415. Both ends of the Velcro 700 may be fixed on the opposite surfaces of the movable members 410 and 420 through the use of an adhesive.

If the apparatus for cleaning floor according to the present invention is operated while placed in water, the adhesive strength may be weakened between the Velcro 700 and the movable members 410 and 420. In this aspect, as shown in FIG. 6, preferably, the both ends of the Velcro 700 are fixed to the opposite surfaces of the movable members 410 and 420 through the use of press members 800. Each of the press members 800 includes an uneven part 810 so as to increase a contact area with the Velcro 700.

Also, the movable member 410 and 420 includes a holding part 440 for holding the press member 800. The holding part 440 is provided with a projection 441 to prevent the press part 800 from being separated from the movable member 410 and 420. That is, the press member 800 is slidingly inserted into the holding part 400, but the pressing member 800 can not be separated from the holding part 400.

As explained above, the apparatus for cleaning floor according to the present invention has the following advantages.

First, the apparatus for cleaning floor whose floorcloth or brush rectilinearly reciprocates on the floor automatically, resulting in good cleaning performance without a user's heavy work. Also, in the case of the apparatus for cleaning floor according to the present invention, it is capable of changing its moving direction without user's inconvenience caused by jolts or vibration generated when the floorcloth or brush automatically reciprocates in a straight line on the floor.

In the case using the pulley and pulley belt according to the embodiment of the present invention, it is possible to minimize the noise generated when operating the apparatus for cleaning floor.

The apparatus for cleaning floor according to the present invention, which includes the waterproofing part, can perform the wet cleaning of tiled floor without the danger such as electric shock. Also, the apparatus for cleaning floor according to the present invention enables easy washing of floorcloth or brush without being touched.

The apparatus for cleaning floor according to the present invention, which includes the course guiding means, can secure the high preciseness in rectilinear reciprocating motion of the movable member by preventing the deviation of movable member when the movable with the floorcloth or brush attached thereon reciprocates rectilinearly, to thereby minimize the vibration and noise generated when operating the apparatus.

Also, the Velcro for detachably providing the cleaning member such as floorcloth or brush is fixed on the apparatus for cleaning floor by the physical force. Accordingly, even though the apparatus for cleaning floor according to the present invention is operated for a long time so as to perform the wet cleaning for the tiled floor or the automatic cleaning of the movable member, the Velcro is not detached from the apparatus for cleaning floor according to the present invention, thereby realizing the enhanced endurance.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An apparatus for cleaning floor comprising:

a support member;

a driver positioned on the support member;

a power converter for converting a rotary motion provided from the driver into a power for a rectilinear reciprocating motion;

first and second movable members rectilinearly reciprocating along the same straight line in opposite directions with each other through the use of power provided from the power converter; and first and second course guiding means to guide the rectilinear reciprocating motions of the first and second movable members, respectively, wherein the driver comprises:

a driving motor;

a first interlocking pulley rotated by the driving motor;

a second interlocking pulley; and an interlocking timing belt for transmitting a rotary motion of the first interlocking pulley to the second interlocking pulley, wherein the first course guiding means comprises:

a sliding member mounted on the first movable member and rectilinearly reciprocating together with the first movable member; and a guide member, fixed on the support member, for guiding the rectilinear reciprocating motion of the sliding member, and wherein the sliding member comprises:

a shaft; and a first damper, mounted on each of both ends of the shaft, for dampering shock and noise generated by vibration of the apparatus.

2. The apparatus according to claim 1, wherein the first and second interlocking pulleys have the same diameter to be rotated at the same speed.

3. The apparatus according to claim 1, wherein the driver comprises:

a speed-reduction pulley; and a motor timing belt for transmitting the rotary motion of the driving motor to the speed-reduction pulley, wherein the first interlocking pulley is rotated in association with the speed-reduction pulley.

4. The apparatus according to claim 1, wherein the driver comprises:

a first interlocking pulley shaft connected with the center of the first interlocking pulley and rotated in association with the first interlocking pulley; and a second interlocking pulley shaft connected with the center of the second interlocking pulley and rotated in association with the second interlocking pulley.

5. The apparatus according to claim 4, wherein the power converter comprises:

a first power converting member for converting the rotary motion of the first interlocking pulley shaft into a rectilinear reciprocating motion, and making the first movable member reciprocate rectilinearly; and a second power converting member for converting the rotary motion of the second interlocking pulley shaft into a rectilinear reciprocating motion, and making the second movable member reciprocate rectilinearly.

6. The apparatus according to claim 1, wherein the guide member comprises:

a hollow cylinder into which shaft is inserted; and a bracket for fixing the hollow cylinder on the support member.

7. The apparatus according to claim 6, wherein the guide member includes a bearing inserted into the hollow cylinder so as to secure the smooth rectilinear reciprocating motion of the shaft.

8. The apparatus according to claim 6, wherein the guide member includes a second damper, positioned between the hollow cylinder and the bracket, for decreasing the vibration caused by the rectilinear reciprocating motion of the shaft.

9. The apparatus according to claim 1, wherein a holding part is formed in the lower surface of the support member so as to hold the guide member therein.

10. The apparatus according to claim 1, further comprising a waterproofing part for waterproofing the driver.

11. The apparatus according to claim 10, wherein the waterproofing part comprises:

a waterproofing cover connected with the support member; and a waterproofing ring positioned between the waterproofing cover and the support member.

12. The apparatus according to claim 11, wherein a wire for supplying the power to the driver passes through a hole formed in the waterproofing cover; and an elastic member inserted into the hole is formed in the waterproofing part so as to prevent water from leaking through the hole.

13. The apparatus according to claim 12, wherein the elastic member includes a hole through which the wire is passed.

14. An apparatus for cleaning floor comprising:

a support member;

a driver positioned on the support member;

a power converter for converting a rotary motion provided from the driver into the power for a rectilinear reciprocating motion;

first and second movable members rectilinearly reciprocating along the same straight line in opposite directions with each other through the use of power provided from the power converter; and a hook and loop material fixed on the first and second movable members so as to detachably provide a cleaning member on the first and second movable members, wherein the driver comprises:

a driving motor;

a first interlocking pulley rotated by the driving motor;

a second interlocking pulley; and an interlocking timing belt for transmitting a rotary motion of the first interlocking pulley to the second interlocking pulley, wherein the first movable member comprises first and second holes and a combining rib positioned between the first and second holes, and wherein the hook and loop material is fixed on the combining rib by leading along a path from an inlet of the first hole to an outlet of the second hole.

15. The apparatus according to claim 14, further comprising:

fixation holes formed at both ends of the first movable member; and press members for fixedly holding both ends of the hook and loop material led through the fixation holes, wherein each of the press members includes an uneven part so as to increase a contact area with the hook and loop material.

16. The apparatus according to claim 15, wherein the first movable member includes a holding part for holding the press member, and the holding part is provided with a projection to prevent separation of the press member.

* * * * *